US009120318B2

(12) United States Patent
Kambe

(10) Patent No.: US 9,120,318 B2
(45) Date of Patent: Sep. 1, 2015

(54) INKJET PRINTER

(71) Applicant: SEIKO I INFOTECH INC., Chiba-shi, Chiba (JP)

(72) Inventor: Hiroaki Kambe, Chiba (JP)

(73) Assignee: SEIKO I INFOTECH INC. (JP)

( * ) Notice: Subject to any disclaimer, the term of this patent is extended or adjusted under 35 U.S.C. 154(b) by 0 days.

(21) Appl. No.: 14/368,692

(22) PCT Filed: Feb. 13, 2013

(86) PCT No.: PCT/JP2013/053353
§ 371 (c)(1),
(2) Date: Jun. 25, 2014

(87) PCT Pub. No.: WO2013/157290
PCT Pub. Date: Oct. 24, 2013

(65) Prior Publication Data

US 2015/0062242 A1 Mar. 5, 2015

(30) Foreign Application Priority Data

Apr. 20, 2012 (JP) ..... 2012-096584
Jan. 15, 2013 (JP) ..... 2013-004811

(51) Int. Cl.
*B41J 2/165* (2006.01)

(52) U.S. Cl.
CPC ..... *B41J 2/16538* (2013.01); *B41J 2/16544* (2013.01)

(58) Field of Classification Search
CPC ..... B41J 2/16538; B41J 2/16535; B41J 2/16585; B41J 2/16547; B41J 2/16541
USPC ..... 347/29–34
See application file for complete search history.

(56) References Cited

U.S. PATENT DOCUMENTS

| | | | | |
|---|---|---|---|---|
| 7,052,106 | B1 * | 5/2006 | Onuma et al. | 347/22 |
| 2007/0070116 | A1 * | 3/2007 | Kojima | 347/33 |
| 2008/0136857 | A1 * | 6/2008 | Ogasawara et al. | 347/18 |

FOREIGN PATENT DOCUMENTS

| | | |
|---|---|---|
| JP | 3233164 | 9/2001 |

* cited by examiner

*Primary Examiner* — Manish S Shah
*Assistant Examiner* — Yaovi Ameh
(74) *Attorney, Agent, or Firm* — Adams & Wilks

(57) ABSTRACT

An inkjet printer includes a print head that moves in a main scanning direction for ejecting ink from a nozzle, and a wiper blade that moves in a direction intersecting with the main scanning direction for wiping a nozzle surface of the print head on which the nozzle is formed. The wiper blade includes a wiping portion for effectively wiping the print head, and the nozzle surface has a wiping area divided into plural sections each having a width of the effective wiping portion and being partially overlapped with one another in the main scanning direction. When the print head is wiped by the wiper blade, the print head moves in the main scanning direction and the effective wiping portion is arranged at a wiping position corresponding to any one of the plural sections, and the print head is wiped at least twice while the wiping position is changed.

7 Claims, 9 Drawing Sheets

INKJET PRINTER

TECHNICAL FIELD

The present invention relates to an inkjet printer for recording an image by ejecting ink.

BACKGROUND ART

Inkjet printers have been required to attain improved durability and reliability, as well as attaining high-speed operation and high image quality. If a foreign matter adheres on a nozzle surface of an inkjet head, an ejection failure may occur due to the foreign matter. To address the problem, a typical inkjet printer is configured so that ink adhering on the nozzle surface of the inkjet head may be wiped off by a wiper blade made of an elastic member to remove an adhering matter. The wiper blade for removing an adhering matter uses one blade to wipe one or a plurality of inkjet heads for cleaning. Particularly in a configuration in which one wiper blade is used to wipe a plurality of inkjet heads, the frequency of use of the wiper blade is increased and multiplied by the number of inkjet heads. Accordingly, as compared to a configuration in which one wiper blade wipes one inkjet head, the durability and reliability of the wiper blade are liable to be reduced and the life tends to be shortened.

For example, JP 3233164 B is known as the related art. This related art includes a mechanism of wiping a nozzle surface of a head by a wiper blade. Guide members are provided on both sides of the nozzle surface of the head, and wiping means for cleaning the nozzle surface is provided. A slit is formed in the wiping means correspondingly to the width of a recessed portion of the nozzle surface, and hence, for example, in the case where the guide members are made of metal and the wiping means is an elastic member such as rubber, when the nozzle surface is wiped across an edge portion of the guide member, the wiping means is remarkably deformed and may heavily be consumed.

CITATION LIST

Patent Literature

[PTL 1] JP 3233164 B

SUMMARY OF INVENTION

Technical Problem

In the related art, the wiper blade and the inkjet head have a fixed positional relationship in wiping. Accordingly, the tip of the wiper blade is always brought into contact with a specific position of the inkjet head. The tip of the wiper blade is worn away by different amounts depending on locations, and its cleaning performance greatly degrades at the location where the wear amount is large. At the location where the wear amount is small, on the other hand, the cleaning performance of the wiper blade less degrades and the wiper blade is still usable. The life of the wiper blade is determined based on a specific location of the tip. If the life of the wiper blade can be prolonged, a useful printer with the reduced frequency of replacements can be provided.

Solution to Problem

According to one embodiment of the present invention, there is provided an inkjet printer, including: a print head configured to move in a main scanning direction, for ejecting ink from a nozzle; and a wiper blade configured to move in a direction intersecting with the main scanning direction, for wiping a nozzle surface of the print head on which the nozzle is formed, in which the wiper blade includes an effective wiping portion for effectively wiping the print head, in which the nozzle surface has a wiping area to be wiped by the effective wiping portion, which is determined in advance in the main scanning direction, the wiping area being divided into a plurality of sections each having a width of the effective wiping portion and being partially overlapped with one another in the main scanning direction, and in which, when the print head is wiped by the wiper blade, the print head moves in the main scanning direction and the effective wiping portion is arranged at a wiping position corresponding to any one of the plurality of sections, and the print head is wiped at least twice while the wiping position is changed, to thereby wipe all portions within the wiping area by the effective wiping portion.

Advantageous Effects of Invention

According to one embodiment of the present invention, the difference in wear amount of the tip of the wiper blade depending on locations can be reduced to prevent only a specific portion thereof from being extremely greatly worn away and thereby prolong the life.

DETAILED DESCRIPTION OF EMBODIMENTS

Figure 1:
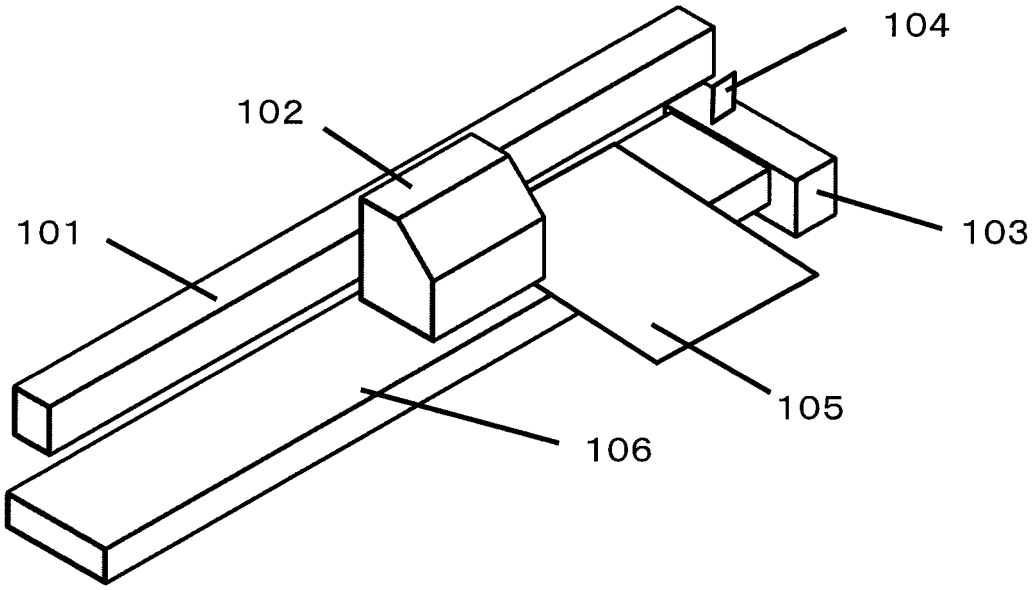
FIG. 1 is a schematic perspective view of an inkjet printer.

The outline of an embodiment of the present invention is now described. In an inkjet printer, a print head for ejecting ink is mounted in a carriage. The carriage reciprocates along a straight Y rail, and ink is ejected from the print head onto a desired position, to thereby form an image. The print head includes a nozzle array in which a plurality of nozzles are arranged in line in a direction orthogonal to a main scanning direction as a longitudinal direction of the Y rail.

The carriage is moved in the main scanning direction, and ink is ejected from the print head onto a recording medium supported by a platen. A wiping unit is provided in a non-printing region in the main scanning direction, that is, outside the platen. The wiping unit includes a wiper blade, and the wiper blade wipes a nozzle surface of the inkjet head while moving in a direction intersecting with the main scanning direction. The wiper blade is movable to a non-wiping position at which the wiper blade is not brought into contact with the nozzle surface of the print head, and hence the wiper blade is not brought into contact with the nozzle surface of the print head when the print head is printing. Further, in a case where a plurality of print heads are mounted and one wiper blade is provided, the first print head is moved to a wiping position and wiped, and after that, the wiper blade is once moved to the non-wiping position, and the next print head is moved to the wiping position and wiped. The amount of movement of the carriage usually matches with an interval of the print heads.

The position of the wiper blade with respect to the print head in the main scanning direction falls within a predetermined given area. When the print head is wiped by the wiper blade, the print head is not moved but fixed, and the wiper blade is moved in a sub-scanning direction to wipe the print head. The position of the wiper blade with respect to the print head in the main scanning direction is selected and determined from among a plurality of predetermined positions. This position can be any position in the given area as long as the nozzle surface of the print head and the wiper blade are brought into contact with each other. For example, in a case where the width of the print head in the main scanning direction is smaller than the width of the wiper blade in the main scanning direction, because it is not desired that the edge of the wiper blade be brought into contact with the print head, the given area can be set in order to avoid the contact. Alternatively, the given area may be determined as an effective area where the wiper blade can wipe the print head effectively, such as the position of the boundary between irregularities in a case where the print head has the irregularities on its surface to be contacted with the wiper blade, the position of the boundary of a water-repellent film or the position at which the kind of water-repellent films changes, and the position at which the kind of materials used changes. Still alternatively, the given area can also be determined with reference to a portion of the wiper blade that can actually effectively wipe the nozzle surface of the print head, in other words, the width of the portion to be contacted with the print head, the position of a slit, the position of the boundary of a water-repellent film or the position at which the kind of water-repellent films changes, the position at which the kind of materials of the wiper blade components changes, or the like. The given area and the opposed position of the print head and the wiper blade in the main scanning direction are set in advance and are responsible for control of operations.

Further, the positions that can be changed within the given area may be discrete positions obtained by dividing a given area by an appropriate number at equal intervals, or may be positions that segmentalize the divided areas based on the center of the area or a specific position such as the position of the boundary of a water-repellent film or the position at which the kind of material changes, the center line on component dimensions, and the nozzle position. Alternatively, the variable positions in the given area may not be definitely determined but may be set randomly. In addition, because the same position is not wiped continuously, the wear of the wiper blade can be averaged.

The position of the wiper blade may be changed for each wiping in a case where one wiper sequence includes a plurality of times of wiping. The inkjet printer can include means for storing the previous wiping position, so as to set the wiping positions to sequentially vary in a plurality of times of wiping. For example, in the case of wiping the print head five times, the five wiping positions may be different from one another. Alternatively, less than five positions may be used while being varied in sequence.

Further, the wiping position is fixed in the first wiper sequence but a position different from the position in the previous wiper sequence may be used in the next wiper sequence, to thereby change the position for each wiper sequence to avoid the same position from being always wiped. Control may be performed to use a position different from that in the second last wiper sequence or prior.

In addition, in a case where a plurality of print heads are mounted, when the print heads are wiped in one wiper sequence, the relative positions of the respective print heads and the wiper blade may be varied to use a plurality of different positions in one wiper sequence. Note that, the wiping position may be determined by combining the above-mentioned position selecting means.

The wiper blade is movable in the direction orthogonal to the main scanning direction, and the wiper blade reciprocates. Control may be performed to vary the position of the wiper blade only in outward movement or only in homeward movement, or in reciprocating movement.

As described above, the wiping position is changed based on the kind and shape of the wiper blade, the kind and shape of the print head, and the like, and hence a specific position of the print head and a specific position of the wiper blade are prevented from being always brought into contact with each other. Consequently, an increase in wear amount at the specific position of the wiper blade can be suppressed to prolong the life of the wiper blade.

Figure 2:
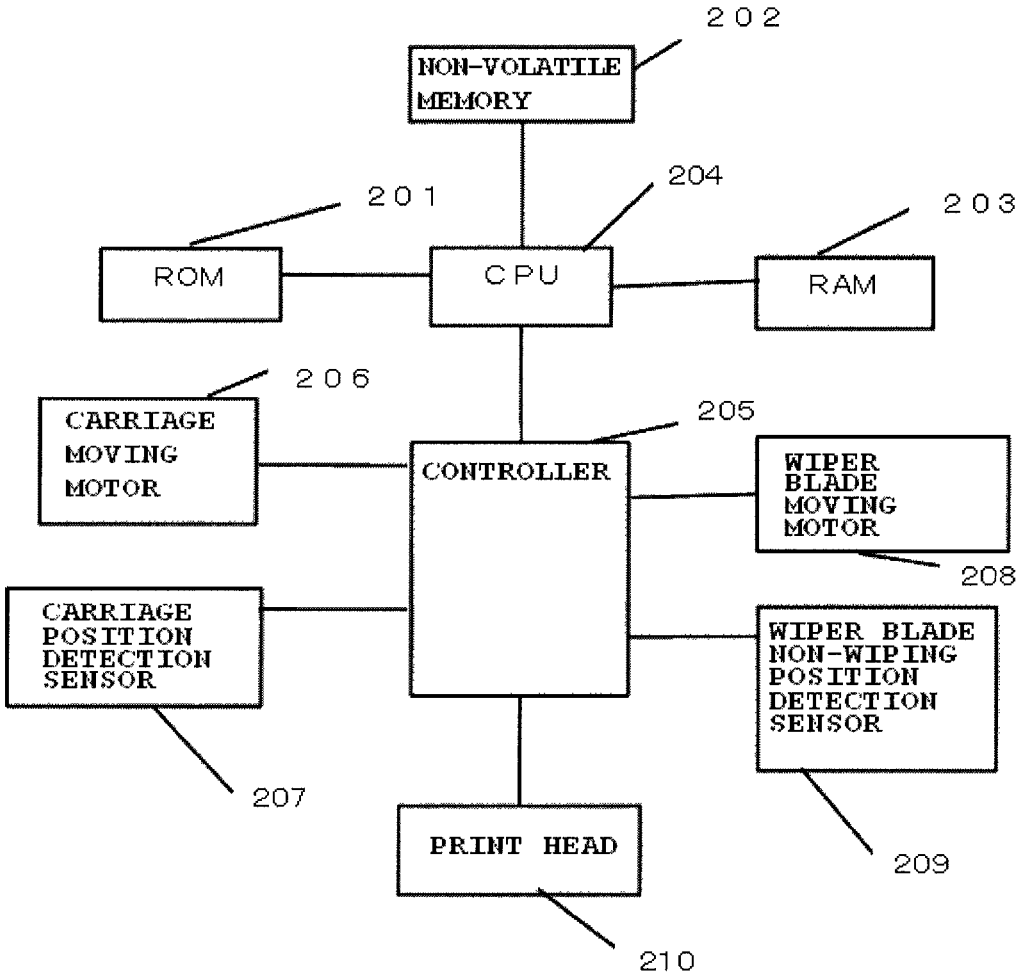
FIG. 2 is a block diagram of the inkjet printer.
Figure 3A:
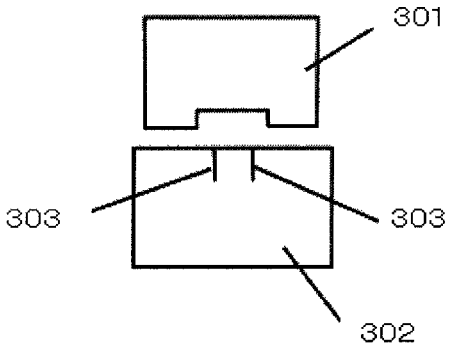
FIG. 3 are views illustrating an example of a wiper blade.
Figure 3B:
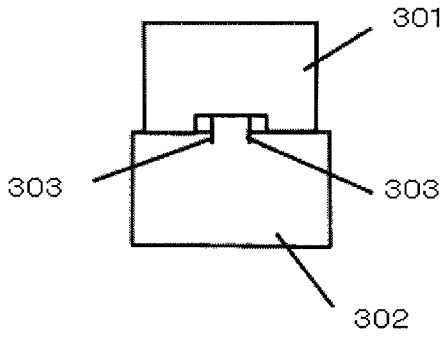
Figure 3C:
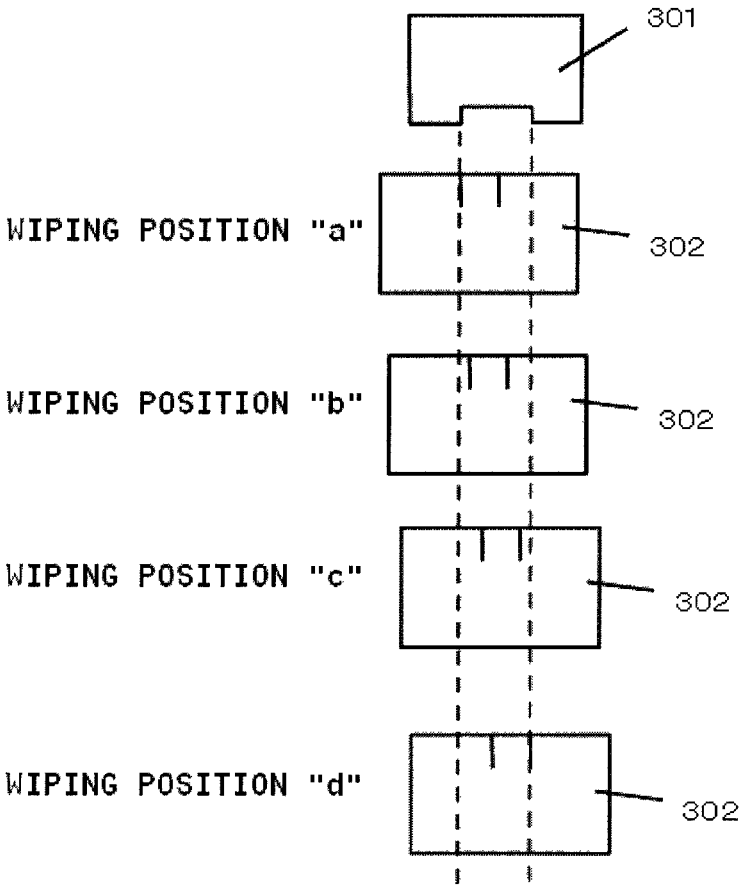
Figure 4:
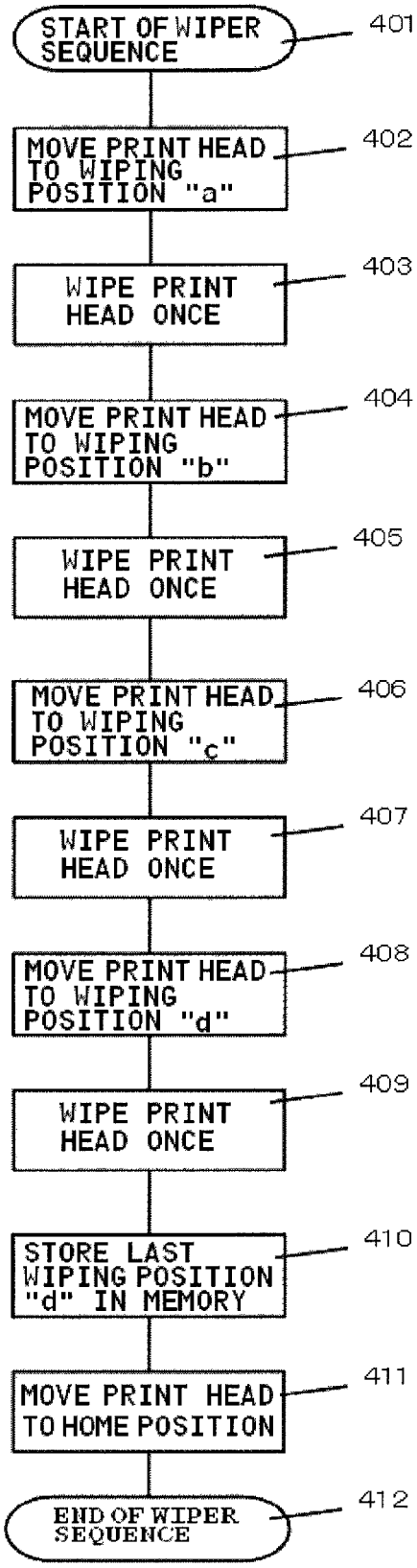
FIG. 4 is a flowchart illustrating an example of a wiper sequence.
Figure 5A:
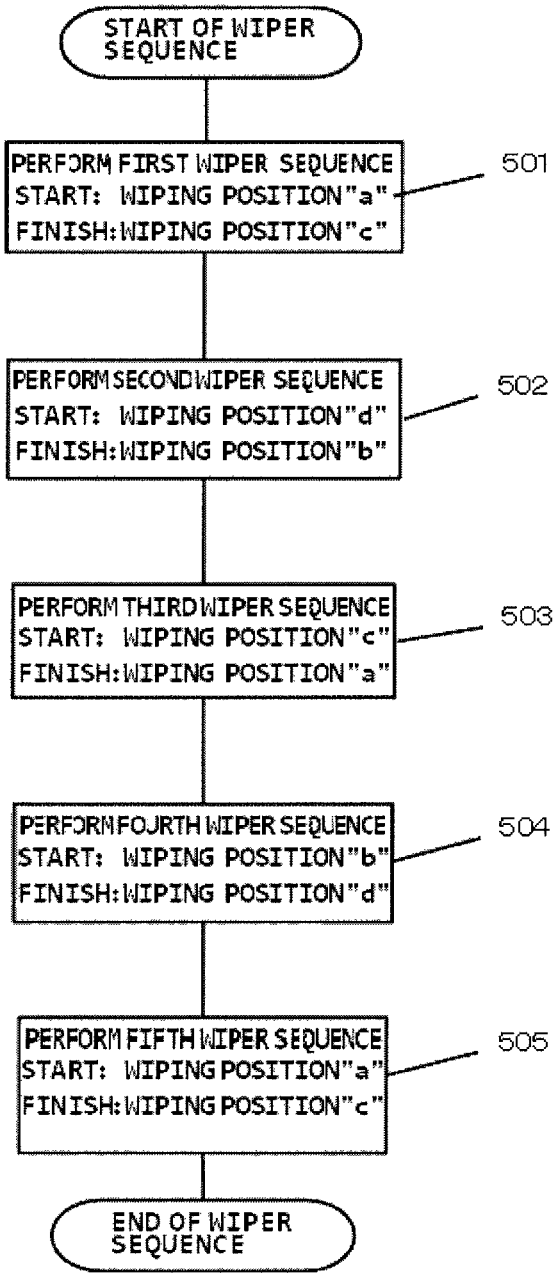
FIGS. 5(*a*)-5(*b*) are flowcharts illustrating an example where the wiper sequence is performed for a plurality of times.
Figure 5B:
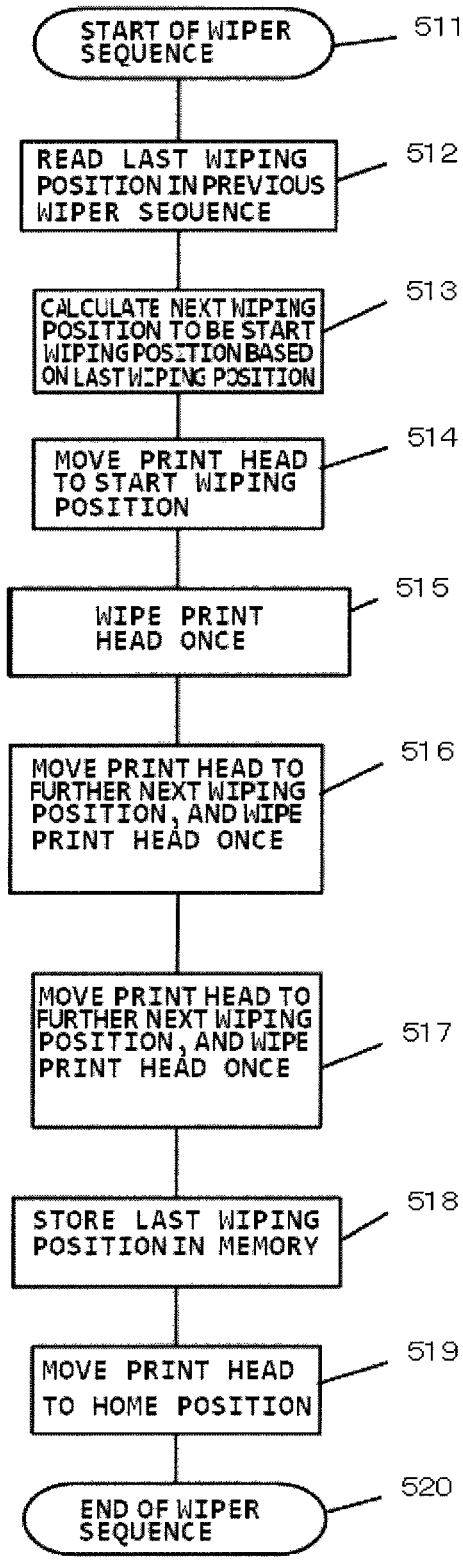
Figure 6A:
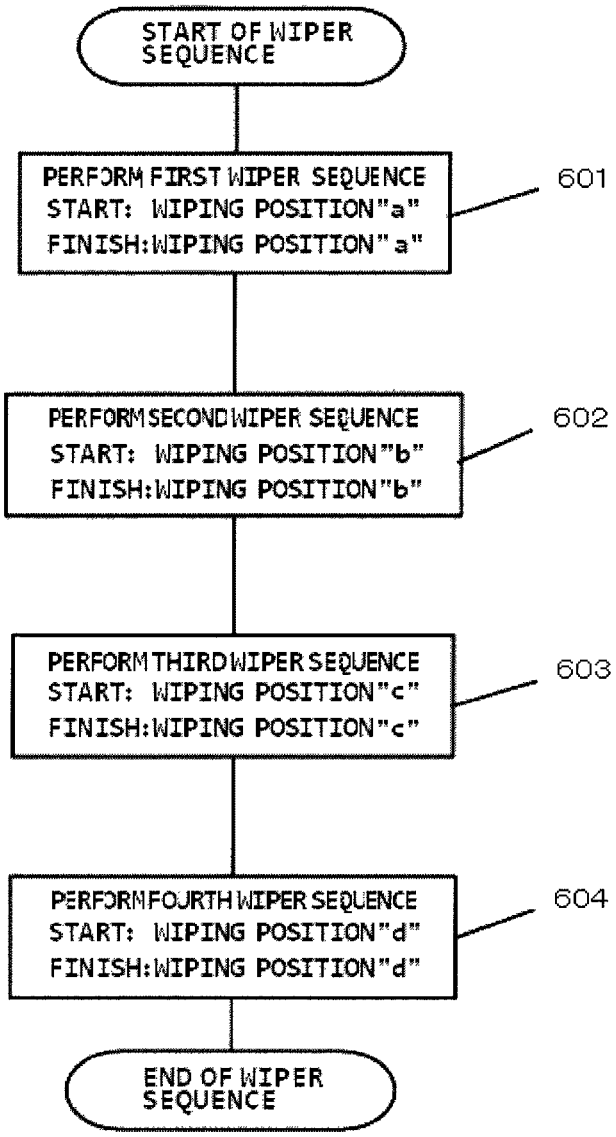
FIGS. 6(*a*)-6(*b*) are flowcharts illustrating another example where the wiper sequence is performed for a plurality of times.
Figure 6B:
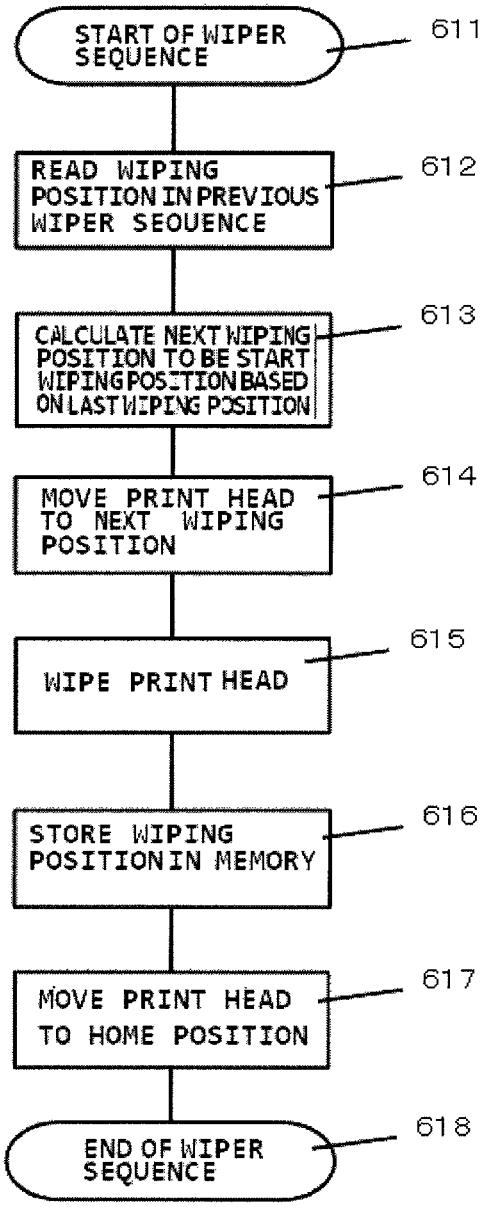
Figure 7A:
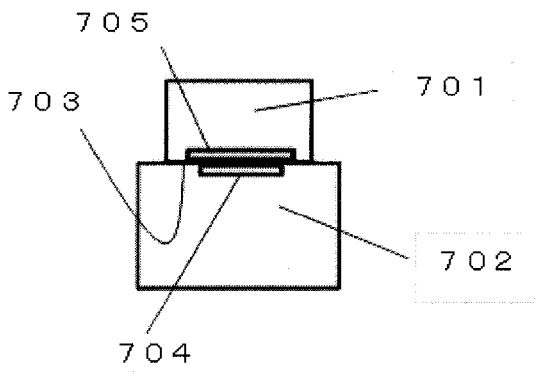
FIGS. 7(*a*)-7(*d*) are views illustrating another example of the wiper blade.
Figure 7B:
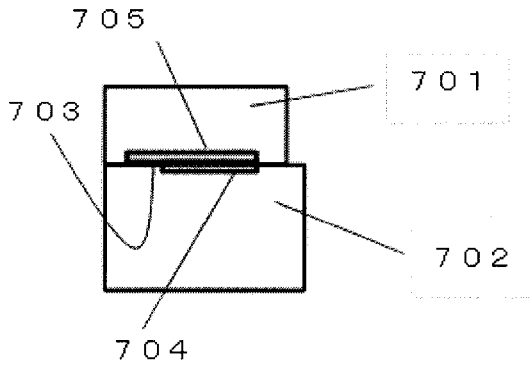
Figure 7C:
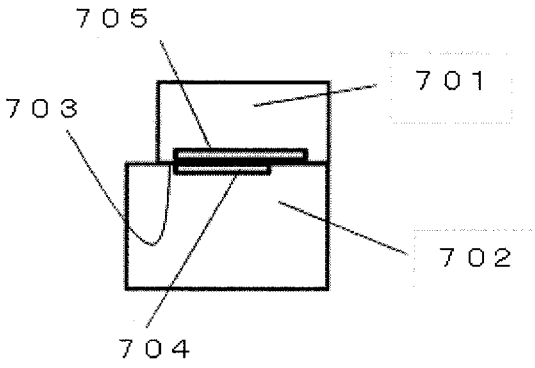
Figure 7D:
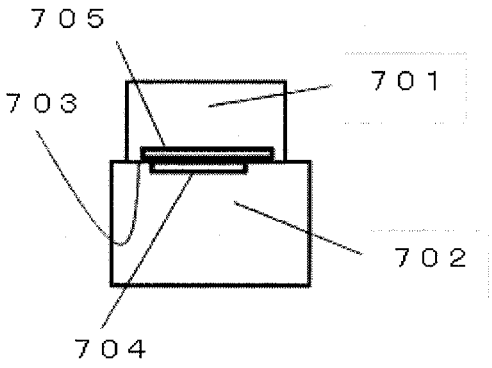
Figure 8A:
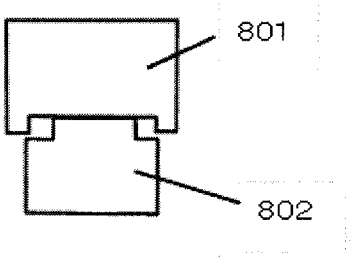
FIGS. 8(*a*)-8(*c*) are views illustrating still another example of the wiper blade.
Figure 8B:
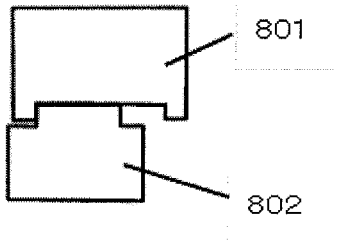
Figure 8C:
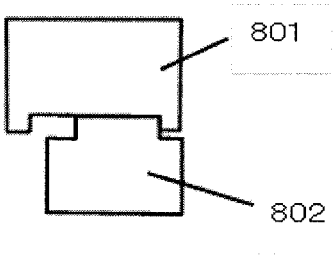

The embodiment of the present invention is described below with reference to the drawings. FIG. 1 is a schematic perspective view of an inkjet printer. FIG. 2 is a block diagram of the inkjet printer. FIGS. 3(*a*)-3(*c*) are views illustrating an example of a wiper blade. FIG. 4 is a flowchart of a wiper sequence. FIGS. 5(*a*)-5(*b*) are flowcharts illustrating an example where the wiper sequence is performed for a plurality of times. FIGS. 6(*a*)-6(*b*) are flowcharts illustrating another example where the wiper sequence is performed for a plurality of times. FIGS. 7(*a*)-7(*d*) are views illustrating another example of the wiper blade. FIGS. 8(*a*)-8(*c*) are views illustrating still another example of the wiper blade. The embodiment of the present invention is described with reference to those drawings.

FIG. 1 is a schematic perspective view of the inkjet printer. The inkjet printer includes a straight Y rail 101 serving as a guide for a carriage 102 that holds print heads (not shown). The carriage 102 moves along a main scanning direction, which is a longitudinal direction of the Y rail 101. A plate-shaped platen 106 is located along the Y rail 101, and a recording medium 105 is conveyed between the Y rail 101 and the platen 106 in a direction intersecting with the Y rail 101, in this case, in a direction orthogonal to the Y rail 101, that is, a sub-scanning direction. The direction of conveyance is referred to as "discharge direction". While the carriage 102 is moving in the main scanning direction, ink is ejected from the print heads to form an image on the recording medium 105. A wiping unit 103 is located in a non-printing region outside the platen 106. The wiping unit 103 holds a wiper blade 104 so that the wiper blade 104 is movable in the direction orthogonal to the main scanning direction. In the carriage 102, the print heads corresponding to a plurality of printing colors are arranged in the main scanning direction. In printing, the wiper blade 104 is movable to a non-wiping position at which the wiper blade 104 is not brought into contact with the print heads when the carriage 102 operates in the main scanning direction. In wiping, the carriage 102 moves to the position of the wiper blade 104, thus allowing the print heads to be wiped. The carriage 102 in this case moves to a position at which the wiper blade 104 and a print head to be wiped by the wiper blade 104 are opposed to each other. One wiper blade 104 is provided in FIG. 1, but a plurality of the wiper blades 104 may be arranged correspondingly to the number of the print heads. Control means (not shown) performs wiping control so that the wiper blade 104 may wipe the print head. This control involves moving the carriage 102 to the position at which the print head is opposed to the wiper blade 104. Next, the wiper blade 104 is controlled to move in the direction orthogonal to the main scanning direction. In other words, the print head is wiped by the wiper blade 104. The control means is capable of moving the print head to the position at which the print head is opposed to the wiper blade 104 in a manner that the print head is stopped at a given position to be described later, which is set in the control means in advance. The control means performs control by following a program stored in advance, and operates in accordance with set values of the stop position of the print head, the number of times of wiping by the wiper blade 104, and the like.

FIG. 2 is a block diagram of the inkjet printer. A CPU 204 is connected to a ROM 201 having a program stored thereon, a non-volatile memory 202 whose data is stored even after the inkjet printer is powered off, and a RAM 203 whose data is lost when the inkjet printer is powered off. The CPU 204 operates in accordance with the program stored in the ROM 201. In this case, the non-volatile memory 202 is used to store data such as the set values, and the RAM 203 is used as a working area for calculation and used to store temporary data. The CPU 204 controls various kinds of operations of the inkjet printer based on the stored pieces of data. A controller 205 is connected to and controlled by the CPU 204. The controller 205 is connected to a carriage moving motor 206 for moving the carriage, a carriage position detection sensor 207 for grasping the position of the carriage, a wiper blade moving motor 208 to be used to move the wiper blade at the time of wiping and move the wiper blade to the non-wiping position, a wiper blade non-wiping position detection sensor 209 for detecting that the wiper blade is retracted to the non-wiping position, a print head 210 for ejecting ink, and various kinds of actuators and sensors (not shown). The controller 205 is controlled by the CPU 204 to drive the respective components.

The controller 205 transmits the states of the actuators such as motors and the sensors to the CPU 204. On the other hand, the CPU 204 controls the operations of the inkjet printer in accordance with the program and based on the states of the various kinds of actuators and sensors. For example, in order to wipe the print head 210, the CPU 204 operates the carriage moving motor 206 and the wiper blade moving motor 208 via the controller 205 based on a programmed wiper sequence. At least one wiping position at which the print head is wiped can be stored in the non-volatile memory 202 or the RAM 203. In wiping, the past wiping position can be called from the non-volatile memory 202 or the RAM 203 to calculate the next wiping position. In addition, by storing the wiping position on the non-volatile memory 202, the past wiping position can be stored even after the inkjet printer is powered off.

FIGS. 3(*a*)-3(*c*) are views of a print head 301 and a wiper blade 302 as viewed in a direction opposite to the discharge direction according to the embodiment of the present invention. FIG. 3(*a*) illustrates a state in which the wiper blade 302 is located at the non-wiping position and is not brought into contact with the print head 301. FIG. 3(*b*) illustrates a state in which the print head 301 is wiped by the wiper blade 302 at a position at which respective center positions of the print head 301 and the wiper blade 302 in the main scanning direction are aligned with each other, and the print head 301 and the wiper blade 302 are brought into contact with each other. FIG. 3(*c*) illustrates an example of a plurality of positions of the wiper blade 302 with respect to the print head 301.

In FIG. 3(*a*), a recessed portion is formed in a surface of the print head 301 that is opposed to the recording medium, and nozzles for ejecting ink are formed in the recessed surface so that this portion serves as a nozzle surface. Two slits 303 are formed in the tip of the wiper blade 302, and an interval therebetween is smaller than the width of the recessed surface of the print head 301. The length of the slit 303 is larger than the depth of the recess of the print head 301. The tip of the wiper blade 302 is divided into three regions by the slits 303, and the respective regions can deform independently when the tip of the wiper blade 302 is brought into contact with the print head 301.

In FIG. 3(*b*), the print head 301 and the wiper blade 302 are in the state of being in contact with each other. The tip of the wiper blade 302 is divided into three regions by the slits 303. A central region of the wiper blade 302 is brought into contact with the nozzle surface of the print head 301 while being curved. On the other hand, regions on both edges of the wiper blade 302 are brought into contact with protruding surfaces of the print head 301, and deform more greatly than the central region. This state is a state in which the nozzle surface of the print head 301 is wiped by the wiper blade 302. Because the length of the slit 303 is larger than the depth of the recess of the print head 301, the three regions of the tip of the wiper blade 302 are brought into contact with the print head 301 without being affected from one another even when the three regions are deformed with different degrees. Further, because the width of the central region of the wiper blade 302, which is brought into contact with the nozzle surface of the print head 301, is smaller than the width of the nozzle surface of the print head 301, the overall width of the nozzle surface cannot be wiped by one wiping.

FIG. 3(*c*) illustrates an example of a plurality of positions of the wiper blade 302 with respect to the print head 301. At a wiping position "a", the left edge of the depression of the recessed shape of the print head 301 is aligned with the position of the left slit 303 of the wiper blade 302. At a wiping position "d", in contrast to the wiping position "a", the right edge of the depression of the recessed shape of the print head 301 is aligned with the position of the right slit 303 of the wiper blade 302. Then, a wiping position "b" and a wiping position "c" are located between the wiping position "a" and the wiping position "d". The wiping position "b" is located to the left, and the wiping position "c" is located to the right. The wiping position "b" and the wiping position "c" can be set at any positions between the wiping position "a" and the wiping position "d" and stored in the non-volatile memory 202. In this example, the wiping position "a" and the wiping position "d" correspond to both edges of a predetermined area where the wiper blade is movable. The nozzle surface can be wiped effectively in this area. The nozzle surface can be wiped by the central region between the slits 303 of the wiper blade 302 in a state in which the central region is less deformed than the regions on both edges of the wiper blade 302. The wiping position "b" and the wiping position "c" can be set at any positions as long as the wiping positions are located in the predetermined area between the wiping position "a" and the wiping position "d". The order of the wiping positions in wiping may be set so that the print head 301 may be wiped in the arranged order of the wiping positions from top to bottom of FIG. 3(*c*). Alternatively, however, in a case where the drying rate of ink to be used is high and the overall width of the recessed shape of the print head 301 needs to be wiped in a period of time as short as possible, the wiping positions may be selected so that the previous wiping position may be followed by a wiping position that is as far as possible from the previous wiping position. An example of such order of the wiping positions include the order of the wiping position "a", the wiping position "d", the wiping position "b", and the wiping position "c". By wiping the print head 301 in this order, the wiper blade 302 can wipe the overall width of the nozzle surface of the print head 301 with a smaller number of times of wiping. Still alternatively, if the order of the wiping positions has no influence on wiping performance, the random order of the wiping positions may be selected. This selection further averages the wear of the wiper blade 302, but it is desired not to select the same wiping position continuously in consideration of the wiping performance of the wiper blade 302 on the print head 301.

FIG. 4 is a flowchart of an example of the wiper sequence. The wiper sequence is started in accordance with the wiping positions illustrated in FIG. 3(*c*) (401). At first, the carriage is moved to move the print head to the wiping position "a" (402). Next, the wiper blade is moved from the non-wiping position to wipe the print head once, and after the wiping, the wiper blade is moved to the non-wiping position (403). Next, the carriage is moved to move the print head to the wiping position "b" (404). Then, the print head is wiped once, and after the wiping, the wiper blade is moved to the non-wiping position (405). Next, the carriage is moved to move the print head to the wiping position "c" (406). Then, the print head is wiped once, and after the wiping, the wiper blade is moved to the non-wiping position (407). Then, the print head is moved to the wiping position "d" (408). Then, the print head is wiped once, and after the wiping, the wiper blade is moved to the non-wiping position (409). The last wiping position, which is the wiping position "d", is stored in the non-volatile memory or the RAM (410). Next, the carriage is moved to a home position (411). This finishes the wiper sequence (412).

Note that, the order of the wiping positions is fixed in this example, and hence the flow 410 may be omitted when it is unnecessary to store the last wiping position. In the wiper sequence in this example, the print head is wiped once at each of the four wiping positions, that is, four times in total. If the print head needs to be wiped six times in total, six wiping positions may be provided in a manner that four wiping positions are set between the wiping position "a" and the wiping position "d". Alternatively, however, the print head may be wiped at the original four wiping positions in a manner that the print head is wiped at the wiping position "a" to the wiping position "d" in order and wiped at the wiping position "a" for the fifth wiping and at the wiping position "b" for the sixth wiping by changing the position in sequence. Alternatively, the print head may be wiped at the wiping position "a" to the wiping position "d" in order and wiped at the wiping position "c" for the fifth wiping and at the wiping position "b" for the sixth wiping before the wiper sequence is finished.

FIG. 5(*a*) and FIG. 5(*b*) are both flowcharts illustrating different examples of the wiper sequence from that of FIG. 4. FIG. 5(*a*) is a flowchart for repeating the same wiper sequence five times. FIG. 5(*b*) is a flowchart of a wiper sequence for implementing the operation of FIG. 5(*a*). In FIG. 5(*a*), the print head is wiped three times in total in each wiper sequence, and the wiper sequence is performed five times. The wiper sequence is programmed so that the wiping positions may come in the order of the wiping position "a", the wiping position "b", the wiping position "c", and the wiping position "d" illustrated in FIG. 3(*c*) followed by the wiping position "a" again, and the wiper sequence is repeated thereafter.

It is desired that the number of the set wiping positions match with the total number of times of wiping in each wiper sequence because the program is simplified. However, some inkjet printers have a plurality of kinds of wiper sequences, and hence it is desired in terms of design of the wiper sequence that the total number of times of wiping be the same in all the wiper sequences, which is however not a restriction. Further, it is not desired to provide different numbers of the set wiping positions for each kind of wiper sequence because the program is complicated. It is therefore desired that the order of the wiping positions be the same not only in one wiper sequence but also in a plurality of continuously performed wiper sequences. The flowchart of the wiper sequence as illustrated in FIG. 5(*b*) implements this configuration. The wiper sequence includes a flow 518 for storing the last wiping position in the non-volatile memory or the RAM. In the next wiper sequence, the last wiping position stored in the flow 518 of the previous wiper sequence is used. When the next wiper sequence is performed, a flow 512 for reading the stored last wiping position of the previous wiper sequence is first performed, and the next wiping position is calculated in a flow 513 based on the stored last wiping position. The rule of calculating the next wiping position can be determined by a program in advance as described above. The carriage holding the print head is moved in accordance with the calculated next wiping position, to thereby perform the first wiping in the wiper sequence. After that, the print head is sequentially moved to the determined wiping positions and wiped, and the last wiping position is stored in the non-volatile memory or the RAM in the flow 518 as described above. Then, the print head is moved to the home position.

Next, the operation in the wiper sequence is described. The wiper sequence is started (511). Next, the last wiping position in the previous wiper sequence is read from the non-volatile memory or the RAM (512). Next, the next wiping position is calculated based on the read last wiping position (513). Next, the print head is moved to the wiping position obtained as a result of the calculation (514). Next, the wiper blade is driven to wipe the nozzle surface, and the wiper blade is moved to the non-wiping position (515). Next, the print head is moved to the next wiping position and wiped, and is moved to the wiper blade non-wiping position (516). Next, the print head is moved to the next wiping position and wiped, and is moved to the wiper blade non-wiping position (517). As a result, the print head has been wiped three times. The last wiping position is stored in the non-volatile memory or the RAM (518). Next, the print head is moved to the home position (519). This finishes one wiper sequence (520).

The order of the wiping positions implemented in one wiper sequence can be applied to the plurality of wiper sequences illustrated in FIG. 5(*a*). As a result, when the wiper sequence is started at the wiping position "a" and finished at the wiping position "c" in the flow 501, the wiping position "c" is stored in the non-volatile memory or the RAM of the inkjet printer as the last wiping position. When the same wiper sequence is repeatedly performed next, the wiper sequence in the flow 502 is started at the wiping position "d" and finished at the wiping position "b", the wiper sequence in the flow 503 is started at the wiping position "c" and finished at the wiping position "a", the wiper sequence in the flow 504 is started at the wiping position "b" and finished at the wiping position "d", and the wiper sequence in the flow 505 is started and finished at the same wiping positions as those in the flow 501, that is, started at the wiping position "a" and finished at the wiping position "d".

Note that, FIG. 5(*a*) illustrates an example where, in the same wiper sequence, the first wiping position in the next wiper sequence is determined based on the last wiping position in the previously performed wiper sequence. Alternatively, however, this operation is applicable not only to the same wiper sequence but also to a combination of wiper sequences of a plurality of different kinds. In addition, a plurality of the last wiping positions may be stored to be used to calculate the next wiping position. FIG. 6(*a*) and FIG. 6(*b*) are flowcharts illustrating examples of another wiper sequence. FIG. 6(*a*) is a flowchart illustrating an example of repeating the wiper sequence four times. FIG. 6(*b*) is a flowchart of a single wiper sequence for implementing the operation of FIG. 6(*a*).

As illustrated in FIG. 6(*a*), the wiper sequences are programmed so that the first wiper sequence may be started and finished at the wiping position "a", the second wiper sequence may be started and finished at the wiping position "b", the third wiper sequence may be started and finished at the wiping position "c", and the fourth wiper sequence may be started and finished at the same wiping position "a" as the first wiper sequence again. In this manner, the inkjet printer is configured so that the wiping position in each wiper sequence is limited to only one position but different wiping positions are selected and wiped when a plurality of wiper sequences are combined. The flowchart of the single wiper sequence illustrated in FIG. 6(*b*) implements this configuration.

The wiper sequence is started (611). Next, the last wiping position in the previous wiper sequence is read (612). Next, based on the read wiping position, the next wiping position is calculated by predetermined calculation (613). Next, the print head is moved to the wiping position obtained by the calculation (614). Next, the print head is wiped (615). Next, the current wiping position is stored in the non-volatile memory or the RAM (616). The print head is moved to the home position (617). Then, the single wiper sequence is finished (618). FIG. 6(*a*) illustrates an example where this single wiper sequence is performed four times. In this flowchart, the first wiper sequence with the start wiping position "a" and the wiping finish position "a" is performed (601). Next, the second wiper sequence with the start wiping position "b" and the wiping finish position "b" is performed (602). Next, the third wiper sequence with the start wiping position "c" and the wiping finish position "c" is performed (603). Next, the fourth wiper sequence with the start wiping position "d" and the wiping finish position "d" is performed (604). In this manner, the print head is cleaned by the four wiper sequences. The first wiper sequence has the same start wiping position as the last wiping position in the previously performed wiper sequence. This is because it is desired to use such a method involving the fixed procedure in the case where there is an optimum wiping procedure based on the configurations of the print head, the wiper blade, and the like.

The wiper sequence includes the flow 616 for storing the wiping position in the non-volatile memory or the RAM. In the next wiper sequence, the wiping position stored in the flow 616 of the previous wiper sequence is used. When the next wiper sequence is performed, the flow 612 for reading the stored wiping position in the previous wiper sequence is first performed, and the next wiping position is calculated in the flow 613 based on the stored wiping position. The rule of calculating the next wiping position is determined by a program in advance as described above. The carriage holding the print head is moved in accordance with the calculated next wiping position, and wiping in the wiper sequence is performed. The wiping position is stored in the non-volatile memory or the volatile memory in the flow 616, and the print head is moved to the home position. In this manner, as illustrated in FIG. 6(*a*), the inkjet printer is configured so that the wiping position in each wiper sequence is limited to only one position but different wiping positions can be selected and wiped when a plurality of wiper sequences are combined.

Note that, FIG. 6(*a*) illustrates an example where, in the same wiper sequence, the wiping position in the next wiper sequence is determined based on the wiping position in the previously performed wiper sequence. Alternatively, however, this operation is applicable not only to the same wiper sequence but also to a combination of wiper sequences of a plurality of different kinds. In addition, a plurality of the last wiping positions may be stored to be used to calculate the next wiping position. Further, in the case of calculating the next start wiping position based on the last wiping position, the wiping positions may be set at every third position, in other words, the wiping position "a" is followed by the wiping position "d", followed by the wiping position "c", and followed by the wiping position "b". This can be implemented by programming with a predetermined calculation method.

FIGS. 7(*a*)-7(*d*) are views of a contact state between a print head 701 and a wiper blade 702 as viewed in a direction opposite to the discharge direction. The left-right direction of the drawing sheet is the main scanning direction. A description is given using one print head 701. The width of the print head 701 in the main scanning direction is smaller than the width of the wiper blade 702 in the main scanning direction. FIG. 7(*a*) illustrates a state in which the center positions of the print head 701 and the wiper blade 702 in the main scanning direction are aligned with each other. A nozzle surface 703 is a surface of the print head 701 on which nozzles are formed. An effective nozzle surface 705 of the nozzle surface 703 is a portion that needs to be wiped by the wiper blade 702. If this portion is dirty, an ejection failure occurs. Portions of the nozzle surface 703 other than the effective nozzle surface 705 may be covered with a protective plate or the like. Further, the effective nozzle surface 705 may be a portion on which a water-repellent film or the like is formed. A central portion of the wiper blade 702 is a wiping effective portion 704. The wiper blade 702 has the effective portion 704 as the portion that can substantially wipe the print head 701, and it is necessary to improve durability of this portion as compared to the other portions.

FIG. 7 (*b*) illustrates a position at which the right edge of the effective nozzle surface 705 is aligned with the right edge of the effective portion 704. FIG. 7(*c*) illustrates a position at which the left edge of the effective nozzle surface 705 is aligned with the left edge of the effective portion 704. When the effective nozzle surface 705 is wiped by the effective portion 704, a given area that needs to be wiped can be set as the area whose both ends are the wiping positions illustrated in FIG. 7(*b*) and FIG. 7(*c*). For example, when the print head 701 is wiped in a state in which the print head 701 and the wiper blade 702 are positioned so that the edge portions of both ends of the print head 701 may be brought into contact with the effective portion 704, there is a fear in that the effective portion 704 is liable to be damaged. It is desired to prevent such damage. It is desired that the effective portion 704 wipe the area other than irregularities as much as possible.

As illustrated in FIG. 7(*d*), the wiper blade 702 may be located at an intermediate position between the positions of FIG. 7(*a*) and FIG. 7(*b*), and the position of FIG. 7(*d*) may be set as one end of a given area that needs to be wiped. This indicates that the effective nozzle surface 705 has a portion where cleaning is particularly always necessary and a portion where cleaning is not always necessary even when slightly dirty because the distance from the nozzle is large. This indicates that the portion where cleaning is particularly always necessary may be set to as an area to be wiped. For example, when the nozzle is located at the center of the effective nozzle surface 705, the edge of the effective nozzle surface 705 has little influence on ink ejection.

The entire effective nozzle surface 705 can be wiped by at least two wiper sequences that include the wiper sequence for wiping the region including the left edge of the effective nozzle surface 705 illustrated in FIG. 7(*b*) and the wiper sequence for wiping the region including the right edge of the effective nozzle surface 705 illustrated in FIG. 7(*c*). When the entire area cannot be wiped by one wiper sequence, a plurality of wiper sequences are performed to wipe the entire effective nozzle surface 705. In one wiper sequence, the region including the nozzle portion where cleaning is particularly always necessary is wiped. There are a plurality of two or more wiping positions of the effective nozzle surface 705, that is, positional relationships between the effective nozzle surface 705 and the wiper blade 702. For example, the wiping positions are determined with a plurality of intervals, such as equal intervals or random intervals. With this, the positions are slightly varied from one to another, and hence even when a problem occurs at a specific portion, another portion can be used for wiping in place of the problematic portion. Further, when the print head is wiped for a plurality of times, control can be performed to prevent the same position to be wiped continuously. Wiping damage can also be prevented from being concentrated only on a specific position.

Next, a description is given of an example where the portion corresponding to the effective nozzle surface 705 is a recessed portion. FIGS. 8(*a*)-8(*c*) are views illustrating that a recessed shape is formed in a surface of a print head 801 that is opposed to the recording medium 105, illustrating a contact state between the print head 801 and a projecting-shaped wiper blade 802 as viewed in the direction opposite to the discharge direction. The left-right direction of the drawing sheet is the main scanning direction. A hollow plate frame is arranged and fixed at the central portion of a nozzle surface of the print head 801 so that nozzles may be arranged at the hollow portion. Accordingly, the cross section of the print head 801 in the main scanning direction is a recessed shape. The width of the depressed portion of the recessed shape of the print head 801 is larger than the width of the protruding portion of the projecting shape of the wiper blade 802 in the main scanning direction. It is desired to wipe the entire region of the recessed portion of the print head 801 by the projecting portion of the wiper blade 802. Further, the depth of the depression of the recessed shape of the print head 801 is smaller than the height of the protruding portion of the projecting shape of the wiper blade 802. Consequently, even when the tip portion of the projecting shape of the wiper blade 802 is brought into contact with the recessed portion of the recessed shape of the print head 801, the base portion of the wiper blade 802 can be prevented from being brought into contact therewith.

FIG. 8(*a*) illustrates a state in which the center positions of the print head 801 and the wiper blade 802 in the main scanning direction are aligned with each other. FIG. 8(*b*) illustrates a state in which the print head 801 and the wiper blade 802 are located so that the left edge of the projecting shape of the wiper blade 802 is aligned with the left edge of the depressed portion of the recessed shape of the print head 801. Further, FIG. 8(*c*) illustrates a state in which the print head 801 and the wiper blade 802 are located so that the right edge of the projecting shape of the wiper blade 802 is aligned with the right edge of the depressed portion of the recessed shape of the print head 801. The positions illustrated in FIG. 8(*b*) and FIG. 8(*c*) serve as both ends of the area where the projecting shape of the wiper blade 802 can wipe the recessed shape of the print head 801, and the both ends can be set as a given area that needs to be wiped. Further, it should be understood that only a necessary part needs to be wiped, and hence in some cases, a narrower region between FIG. 8(*b*) and FIG. 8(*c*) may be wiped as a given area that needs to be wiped.

Figure 9A:
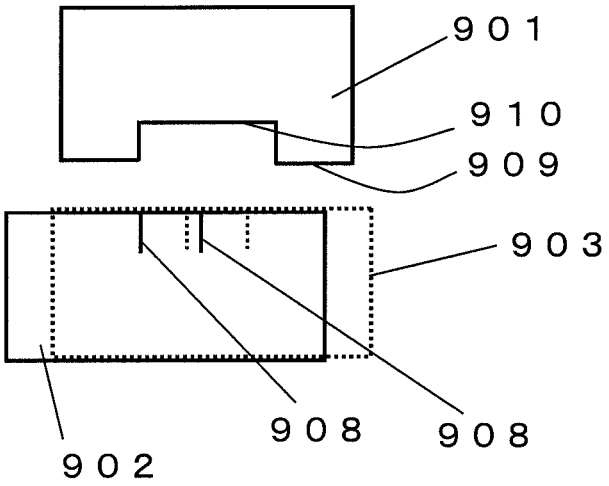
FIGS. 9(*a*)-9(*b*) are views illustrating an example where the number of wiper blades is two.
Figure 9B:
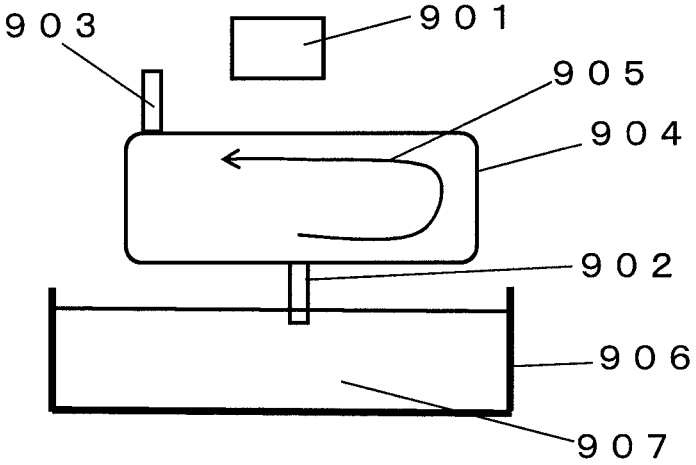

FIGS. 9(*a*)-9(*b*) are views illustrating an example where the number of wiper blades is two. FIG. 9(*a*) is a view illustrating the arrangement of a print head 901, a first wiper blade 902, and a second wiper blade 903. FIG. 9(*b*) is a schematic side view in the case where the number of wiper blades is two.

Two wiper blades, the first wiper blade 902 and the second wiper blade 903, are used to clean the print head 901. The first wiper blade 902 and the second wiper blade 903 are fixed on a belt 904. The belt 904 rotates in the direction of an arrow 905. The belt 904 is capable of rotating in the reverse direction as well. A liquid bath 906 containing a cleaning solution 907 is arranged under the belt 904, and when the belt 904 is rotated, the first wiper blade 902 and the second wiper blade 903 can be immersed in the cleaning solution 907 to remove dirt. The first wiper blade 902 and the second wiper blade 903 each wipe a nozzle surface of the print head 901 in accordance with the rotation of the belt 904.

The first wiper blade 902 and the second wiper blade 903 have the same shape, and are arranged so that the positions of slits 908 may differ when viewed in a travel direction. In the print head 901, the circumference of the nozzle surface 910 is covered with a guard 909, and the nozzle surface 910 serves as a bottom surface of a recessed portion. A plurality of nozzles are arrayed on the nozzle surface 910, and the first wiper blade 902 moves along the array direction of the nozzles. In other words, the nozzles are arrayed along the direction of movement of the first wiper blade 902 and the second wiper blade 903. The distance between the slits 908 is smaller than the width of the recessed portion. Further, the first wiper blade 902 and the second wiper blade 903 are arranged so that, when one slit 908 of the first wiper blade 902 is located near one side wall of the recessed portion, the other slit 908 may be located near the center of the recessed portion. The first wiper blade 902 and the second wiper blade 903 are arranged so that, when the wiper blades are overlapped in the direction of movement, one slit of the second wiper blade 903 may be located between the two slits of the first wiper blade 902. With this arrangement, when the belt 904 is rotated one turn to wipe the nozzle surface 910, a contact portion between the region between the slits of the first wiper blade 902 and the nozzle surface 910 and a contact portion between the region between the slits of the second wiper blade 903 and the nozzle surface 910 partially overlap with each other. A wider area can be wiped with one turn of the belt 904, and hence the number of turns of the belt 904 can be reduced. The usage count of each wiper blade can be reduced.

In wiping, the regions outside the slits 908 of the first wiper blade 902 are brought into contact with the guard 909. The width of the first wiper blade 902 is larger than the width of the print head 901. The first wiper blade 902 is moved relatively in the width direction of the print head 901 in order to wipe the print head 901, and in this case, the regions outside the slits 908 are arranged so as to be each brought into contact with the guard located at the corresponding position. In this way, the wiper blade 902 has the sufficient width, and is capable of wiping the print head 901 sufficiently so that ink adhering on the surface of the guard 909 as well as the nozzle surface 910 may not be left.

In the case of wiping the print head for a plurality of times, because the two wiper blades are provided at the positions deviated from each other in the width direction, as compared to the case where a single wiper blade is provided, the print head can be wiped by an amount corresponding to two turns of the belt 904 when the belt 904 is rotated one turn, and hence the wiper sequence can be finished in a short period of time, and further the usage count of the wiper blade can also be reduced. In addition, although what has been described herein is the case where the number of wiper blades is two, three or more wiper blades may be provided, and the wiper sequence can be finished in a shorter period of time.

INDUSTRIAL APPLICABILITY

The present invention can be used for a printer including an inkjet head.

REFERENCE SIGNS LIST

101 Y rail
102 carriage
103 wiping unit
104 wiper blade
105 recording medium
106 platen
301 print head
302 wiper blade
303 slit
701 print head
702 wiper blade
703 nozzle surface
704 effective portion
705 effective nozzle surface
801 print head
802 wiper blade

The invention claimed is:

1. An inkjet printer, comprising:

a print head configured to move in a main scanning direction for ejecting ink from a nozzle;

a wiper blade configured to move in a direction intersecting with the main scanning direction for wiping a nozzle surface of the print head on which the nozzle is formed, wherein the wiper blade has an effective wiping portion for effectively wiping the print head, wherein the nozzle surface has a wiping area to be wiped by the effective wiping portion, which is determined in advance in the main scanning direction, the wiping area being divided into a plurality of sections each having a width of the effective wiping portion and being partially overlapped with one another in the main scanning direction, wherein, when the nozzle surface of the print head is wiped by the wiper blade, the print head moves in the main scanning direction and the effective wiping portion is arranged at a wiping position corresponding to any one of the plurality of sections, and the print head is wiped at least twice while the wiping position is changed, to thereby wipe all portions within the wiping area by the effective wiping portion, and wherein, when the nozzle surface is wiped by the wiper blade, one of the plurality of sections different from one of the plurality of sections previously wiped is wiped;

storage means for storing, when the nozzle surface is wiped by the wiper blade, the one of the plurality of sections previously wiped by the wiper blade; and calculation means for calculating a next wiping position based on the previously wiped position stored in the storage means.

2. An inkjet printer according to claim 1, wherein the width of the effective wiping portion is smaller than a width of the wiping area.

3. An inkjet printer according to claim 1, wherein the plurality of sections are arranged by dividing the width of the wiping area in the main scanning direction at equal intervals.

4. An inkjet printer according to claim 1, wherein the plurality of sections are arranged by dividing the width of the wiping area in the main scanning direction at random intervals.

5. An inkjet printer according to claim 1, wherein the print head comprises a recessed portion formed in the nozzle surface, wherein the nozzle is arranged at the recessed portion, and wherein the recessed portion serves as the wiping area.

6. An inkjet printer according to claim 1, wherein the wiper blade comprises at least two slits formed in a direction from a tip to a base thereof, and wherein a region between the at least two slits of the wiper blade serves as the effective wiping portion.

7. An inkjet printer according to claim 1, further comprising a belt on which the wiper blade is fixed, for moving the wiper blade along a nozzle array direction of the print head, wherein a plurality of the wiper blades are fixed on the belt, and the plurality of the fixed wiper blades are arranged so that a contact position between the effective wiping portion of each of the plurality of the wiper blades and the print head differs from one wiper blade to another.

* * * * *